US009552753B1

(12) United States Patent
Sivertsen

(10) Patent No.: US 9,552,753 B1
(45) Date of Patent: Jan. 24, 2017

(54) APPARATUS AND METHOD FOR INSPECTION OF DISPLAY DEVICE PIXELS USING PHOTON COLLECTION

(71) Applicant: AMERICAN MEGATRENDS, INC., Norcross, GA (US)

(72) Inventor: Clas Gerhard Sivertsen, Lilburn, GA (US)

(73) Assignee: AMERICAN MEGATRENDS, INC., Norcross, GA (US)

( * ) Notice: Subject to any disclaimer, the term of this patent is extended or adjusted under 35 U.S.C. 154(b) by 729 days.

(21) Appl. No.: 14/061,821

(22) Filed: Oct. 24, 2013

(51) Int. Cl.
*G09G 3/00* (2006.01)

(52) U.S. Cl.
CPC ..... *G09G 3/006* (2013.01)

(58) Field of Classification Search
CPC ..... G09G 3/006; G02F 2001/136254
USPC ..... 324/760.01
See application file for complete search history.

(56) References Cited

U.S. PATENT DOCUMENTS 5,793,221 A * 8/1998 Aoki ..... G02F 1/1309 324/760.01
2013/0242290 A1* 9/2013 Yin ..... G01J 1/0271 356/218
2014/0320137 A1* 10/2014 Liu ..... G09G 3/006 324/414

* cited by examiner

*Primary Examiner* — Koosha Sharifi-Tafreshi
(74) *Attorney, Agent, or Firm* — Locke Lord LLP; Tim Tingkang Xia, Esq.

(57) ABSTRACT

Aspects of the present disclosure directs to inspection of pixels of a display device using photon collection. In certain embodiments, the display device includes a display panel defining multiple pixels in a pixel matrix. A controller divides the pixel matrix into multiple areas, with each area including at least one pixel, and assigns a threshold value for each area. The controller then controls the pixels in one area to emit light displaying a color. A transparent photon collection panel attached to the display panel receives the light displayed by the area, and generates an analog signal in response to the light. An analog to digital (A/D) converter converts the analog signal to a photon current value. The controller receives the photon current values corresponding to each area, and compares the photon current value with the threshold value for each area to determine a flag value for the area.

25 Claims, 6 Drawing Sheets

APPARATUS AND METHOD FOR INSPECTION OF DISPLAY DEVICE PIXELS USING PHOTON COLLECTION

FIELD

The present disclosure generally relates to pixel inspection for display devices, and more particularly to display devices using transparent solar panels for inspection of dead pixels.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Signage devices are widely used to deliver contents in the information broadcasting and advertising areas. Traditionally, signage devices include static display on signage device. Static signage devices may not be easily replaced, and their displays are not flexible and their contents are fixed. With modern technology particularly in the large LED/LCD display area, digital signage devices are currently widely used due to their easy-to-replace characteristics, high efficiencies, relatively low costs, flexible display contents with real-time update ability. The digital signage devices can be used to show television programming, advertisements, traffic information, directional displays, menus, information, and other messages. Signage devices usually utilize technologies such as a matrix of lighting devices (e.g., light bulbs), LCD, LED, plasma displays, or projected images to display content. Digital signage devices can be found in both public and private environments, including retail stores, hotels, restaurants, and corporate buildings, amongst other locations.

However, the display devices of the digital signage devices can become defective due to pixels damaged by capricious weather and harsh outdoor environments. Serious pixel defects may cause the digital signage devices to deliver sub-optimal content. The undiscovered defects or bad pixels constitute a waste to both the advertisers and the society.

Therefore, heretofore unaddressed needs still exist in the art to address the aforementioned deficiencies and inadequacies.

SUMMARY

Certain aspects of the present disclosure direct to a display device, including: a display panel, defining a plurality of pixels in a pixel matrix; a controller configured to control the pixels of the display panel; a transparent photon collection panel attached to the display panel; and an analog to digital (A/D) converter electrically connected to the transparent photon collection panel and the controller. In certain embodiments, the controller includes a processor and a non-volatile memory storing computer executable codes. The codes, when executed at the processor, is configured to: divide the pixel matrix into a plurality of areas, wherein each area comprises at least one pixel, assign a threshold value for each of the areas, control the pixels in one area to emit light displaying a color, and in response, receive a photon current value corresponding to the area, and compare, for each of the areas, the photon current value with the threshold value to determine a flag value for the area. The transparent photon collection panel is configured to receive the light displayed by the area and to generate an analog signal in response to the light. The A/D converter is configured to receive the analog signal from the transparent photon collection panel, to convert the analog signal to the photon current value, and to send the photon current value to the controller.

In certain embodiments, the codes include: a pixel control module configured to generate display signals to control the pixels of the display panel; and a detection module configured to divide the pixel matrix into the areas, to assign the threshold value for each of the areas, to sequentially control the pixels in the areas to emit light displaying a color, to receive the photon current value corresponding to the area, and to compare, for each of the areas, the photon current value with the threshold value to determine the flag value for the area.

In certain embodiments, the display signals include a plurality of scan signals and a plurality of data signals.

In certain embodiments, the display panel includes: a scan driver electrically connected to the controller, configured to receive the scan signals from the controller; a data driver electrically connected to the controller, configured to receive the data signals from the controller; a plurality of scan lines electrically connected to the scan driver, each scan line configured to receive one of the scan signals from the scan driver; and a plurality of data lines electrically connected to the data driver, each data line configured to receive one of the data signals from the data driver; wherein the scan lines and data lines cross over to define the plurality of pixels.

In certain embodiments, the detection module includes: an area dividing module configured to determine a size of each area, and to divide the pixel matrix into the areas according to the size of each area; and a matrix generating module configured to generate at least one threshold matrix storing the threshold values and at least one measurement matrix storing the photon current values for the areas, wherein each of the at least one threshold matrix and the at least one measurement matrix corresponding to a number of the areas.

In certain embodiments, the display panel is a color display panel configured to display in red/green/blue (RGB) colors.

In certain embodiments, the matrix generating module is configured to generate three threshold matrices storing the threshold values for the areas in the RGB colors, respectively; and three measurement matrices storing the photon current values for the areas in the RGB colors, respectively.

In certain embodiments, for each of the areas in each of the RGB colors, the detection module is configured to compare the photon current value stored in the measurement matrix with the threshold value stored in the threshold matrix, and to store the flag value in the measurement matrix.

In certain embodiments, the matrix generating module is configured to generate a result matrix storing a status flag for each area, wherein for each area, the status flag is determined according to the flag values of the RGB colors.

In certain embodiments, the transparent photon collection panel is a transparent solar panel.

Certain aspects of the present disclosure direct to a method of inspecting a display device, including: dividing a display panel of the display device into a plurality of areas, wherein the display panel defines a plurality of pixels in a pixel matrix, and each area comprises at least one pixel; assigning a threshold value for each of the areas; controlling the pixels in one area to emit light displaying a color, wherein a transparent photon collection panel of the display device is configured to receive the light displayed by the area and to generate an analog signal in response to the light, and an analog to digital (A/D) converter of the display device is configured to receive the analog signal from the transparent photon collection panel and to convert the analog signal to a photon current value corresponding to the area; receiving the photon current value corresponding to the area; and comparing, for each of the areas, the photon current value with the threshold value to determine a flag value for the area.

In certain embodiments, the method further includes: generating display signals to control the pixels of the display panel, wherein the display signals include a plurality of scan signals and a plurality of data signals.

In certain embodiments, the display panel includes: a scan driver electrically connected to the controller, configured to receive the scan signals from the controller; a data driver electrically connected to the controller, configured to receive the data signals from the controller; a plurality of scan lines electrically connected to the scan driver, each scan line configured to receive one of the scan signals from the scan driver; and a plurality of data lines electrically connected to the data driver, each data line configured to receive one of the data signals from the data driver; wherein the scan lines and data lines cross over to define the plurality of pixels.

In certain embodiments, the display panel is divided into a plurality of areas by: determining a size of each area; and dividing the pixel matrix into the areas according to the size of each area.

In certain embodiments, the method further includes: generating at least one threshold matrix storing the threshold values and at least one measurement matrix storing the photon current values for the areas, wherein each of the at least one threshold matrix and the at least one measurement matrix corresponding to a number of the areas.

In certain embodiments, the display panel is a color display panel configured to display in red/green/blue (RGB) colors. In certain embodiments, the at least one threshold matrix comprises three threshold matrices storing the threshold values for the areas in the RGB colors, respectively; and the at least one measurement matrix comprises three measurement matrices storing the photon current values for the areas in the RGB colors, respectively.

In certain embodiments, the method further includes: generating a result matrix storing a status flag for each area; storing, for each of the areas in each of the RGB colors, the flag value in the measurement matrix; and determining, for each of the areas, the status flag according to the flag values of the RGB colors.

In certain embodiments, the transparent photon collection panel is a transparent solar panel.

Certain aspects of the present disclosure direct to a non-transitory computer readable medium storing computer executable codes. The codes, when executed at a processor, are configured to: divide a display panel into a plurality of areas, wherein the display panel defines a plurality of pixels in a pixel matrix, and each area includes at least one pixel; assign a threshold value for each of the areas; control the pixels in one area to emit light displaying a color, wherein a transparent photon collection panel of the display device is configured to receive the light displayed by the area and to generate an analog signal in response to the light, and an analog to digital (A/D) converter of the display device is configured to receive the analog signal from the transparent photon collection panel and to convert the analog signal to a photon current value corresponding to the area; receive the photon current value corresponding to the area, and compare, for each of the areas, the photon current value with the threshold value to determine a flag value for the area.

In certain embodiments, the codes include: a pixel control module configured to generate display signals to control the pixels of the display panel, wherein the display signals include a plurality of scan signals and a plurality of data signals; and a detection module configured to divide the pixel matrix into the areas, to assign the threshold value for each of the areas, to sequentially control the pixels in the areas to emit light displaying a color, to receive the photon current value corresponding to the area, and to compare, for each of the areas, the photon current value with the threshold value to determine the flag value for the area.

In certain embodiments, the display panel includes: a scan driver electrically connected to the controller, configured to receive the scan signals from the controller; a data driver electrically connected to the controller, configured to receive the data signals from the controller; a plurality of scan lines electrically connected to the scan driver, each scan line configured to receive one of the scan signals from the scan driver; and a plurality of data lines electrically connected to the data driver, each data line configured to receive one of the data signals from the data driver; wherein the scan lines and data lines cross over to define the plurality of pixels.

In certain embodiments, the detection module includes: an area dividing module configured to determine a size of each area, and to divide the pixel matrix into the areas according to the size of each area; and a matrix generating module configured to generate at least one threshold matrix storing the threshold values and at least one measurement matrix storing the photon current values for the areas, wherein each of the at least one threshold matrix and the at least one measurement matrix corresponding to a number of the areas.

In certain embodiments, the display panel is a color display panel configured to display in red/green/blue (RGB) colors. In certain embodiments, the matrix generating module is configured to generate three threshold matrices storing the threshold values for the areas in the RGB colors, respectively, and three measurement matrices storing the photon current values for the areas in the RGB colors, respectively. In certain embodiments, for each of the areas in each of the RGB colors, the detection module is configured to compare the photon current value stored in the measurement matrix with the threshold value stored in the threshold matrix, and to store the flag value in the measurement matrix.

In certain embodiments, the matrix generating module is configured to generate a result matrix storing a status flag for each area, wherein for each area, the status flag is determined according to the flag values of the RGB colors.

In certain embodiments, the transparent photon collection panel is a transparent solar panel.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The accompanying drawings illustrate one or more embodiments of the disclosure and, together with the written description, serve to explain the principles of the disclosure.

Wherever possible, the same reference numbers are used throughout the drawings to refer to the same or like elements of an embodiment, and wherein.

DETAILED DESCRIPTION

Figure 1A:
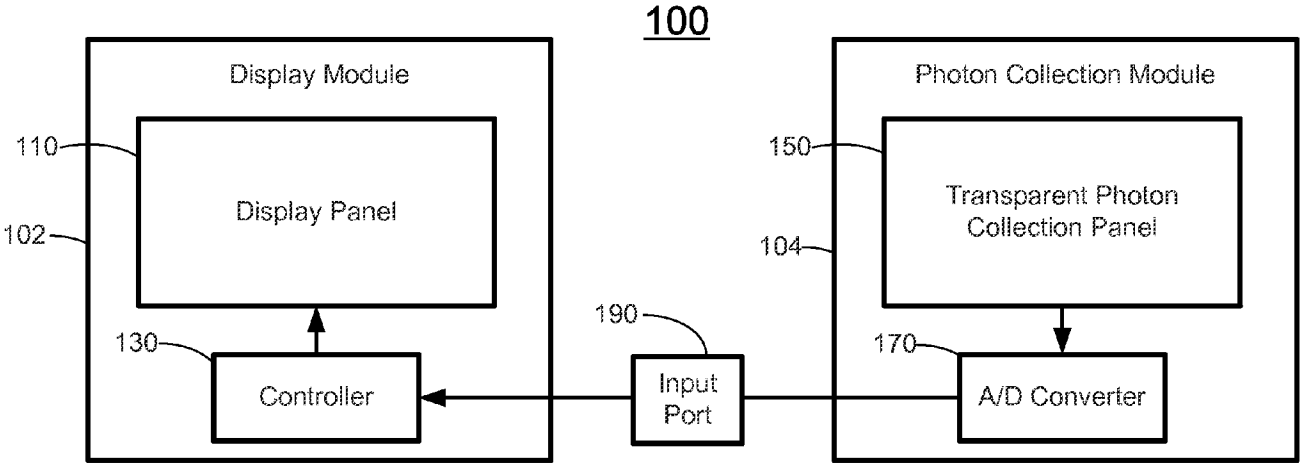
FIG. 1A schematically depicts a display device according to one embodiment of the present disclosure.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

The present disclosure will now be described more fully hereinafter with reference to the accompanying drawings, in which embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout.

Figure 1B:
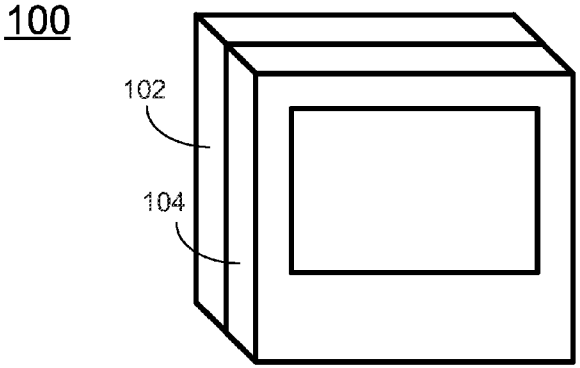
FIG. 1B schematically depicts the assembly of the display device as shown in FIG. 1A according to one embodiment of the present disclosure.

FIGS. 1A and 1B schematically depict a display device according to one embodiment of the present disclosure. In certain embodiments, the display device 100 can be a color display which adopts a color model. In certain embodiments, the display device 100 adopts the RGB color model, which is configured to display a broad array of colors by mixing the three primary colors of red (R), green (G) and blue (B).

As shown in FIG. 1A, the display device 100 includes a display module 102 and a photon collection module 104. The display module 102 includes a display panel 110 and a controller 130. The photon collection module 104 includes a transparent photon collection panel 150 and an analog-to-digital (A/D) converter 170. In the display module 102, the controller 130 is electrically connected to the display panel 110. In the photon collection module 104, the A/D converter 170 is electrically connected to the transparent photon collection panel 150. The A/D converter 170 is electrically connected to the controller 130 by an input port 190. As shown in FIG. 1B, the photon collection module 104 is attached to the display module 102 such that the transparent photon collection panel 150 and the display panel 110 are correspondingly positioned.

The display panel 110 is a panel for displaying images. In certain embodiments, the display panel 110 can be any display panel, such as liquid crystal displays (LCDs), light emitting diodes (LEDs), plasma displays, projector displays, or any other types of displays.

Figure 2A:
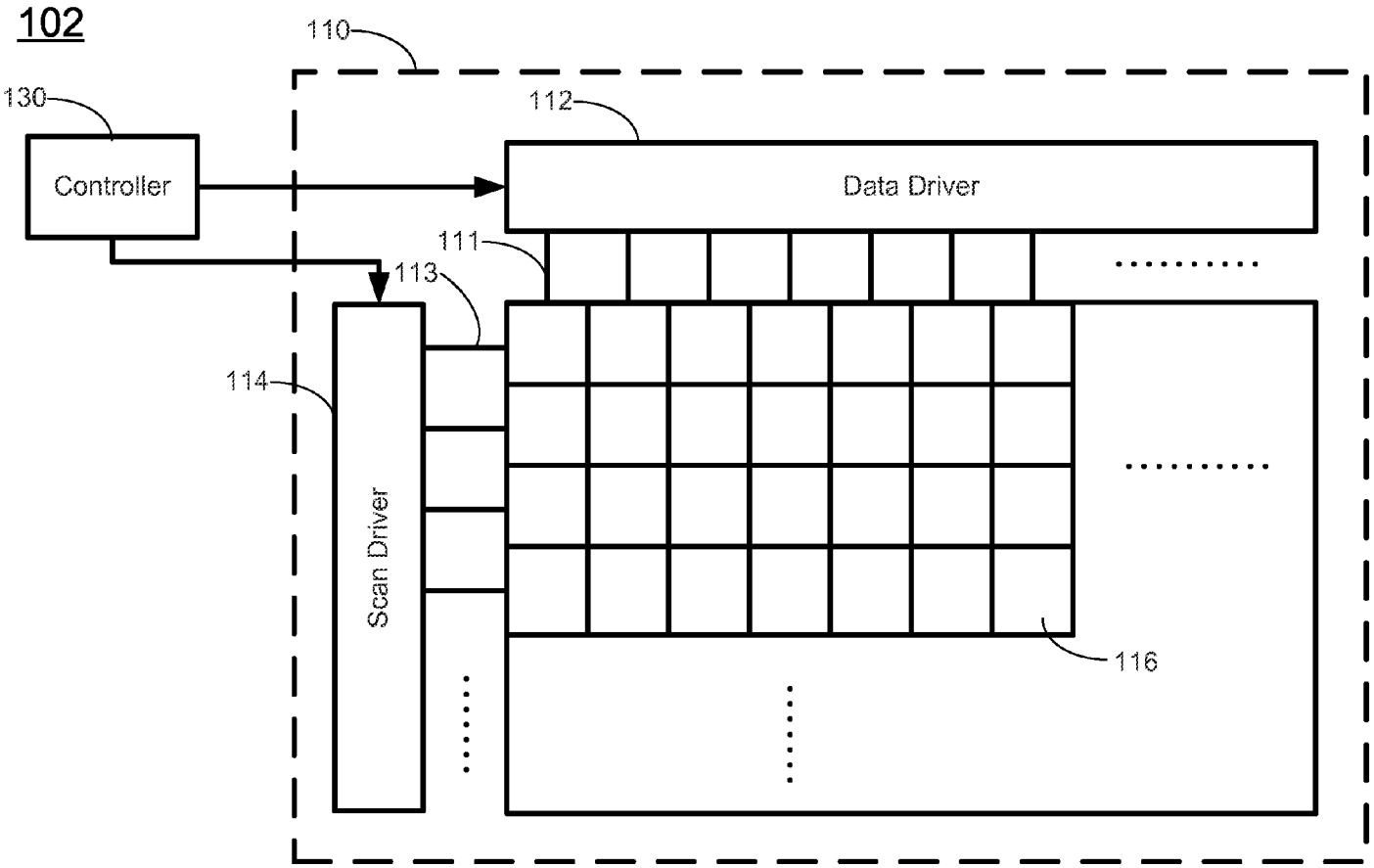
FIG. 2A schematically depicts a display module of a display device according to one embodiment of the present disclosure.

FIG. 2A schematically depicts a display module of the display panel according to one embodiment of the present disclosure. As shown in FIG. 2A, the display panel 110 includes a data driver 112 and a scan driver 114 respectively connected to the controller 130 to receive data signals and scan signals. Further, a plurality of pixels 116 is defined on the display panel 110 to form a pixel matrix. The data driver 112 is electrically connected to a plurality of data lines 111 to transmit the data signals to each of the pixels 116, and the scan driver 114 is electrically connected to a plurality of scan lines 113 to transmit the scan signals to each of the pixels 116. In other words, each pixel 116 is electrically connected to at least one data line 111 and at least one scan line 113.

Figure 2B:
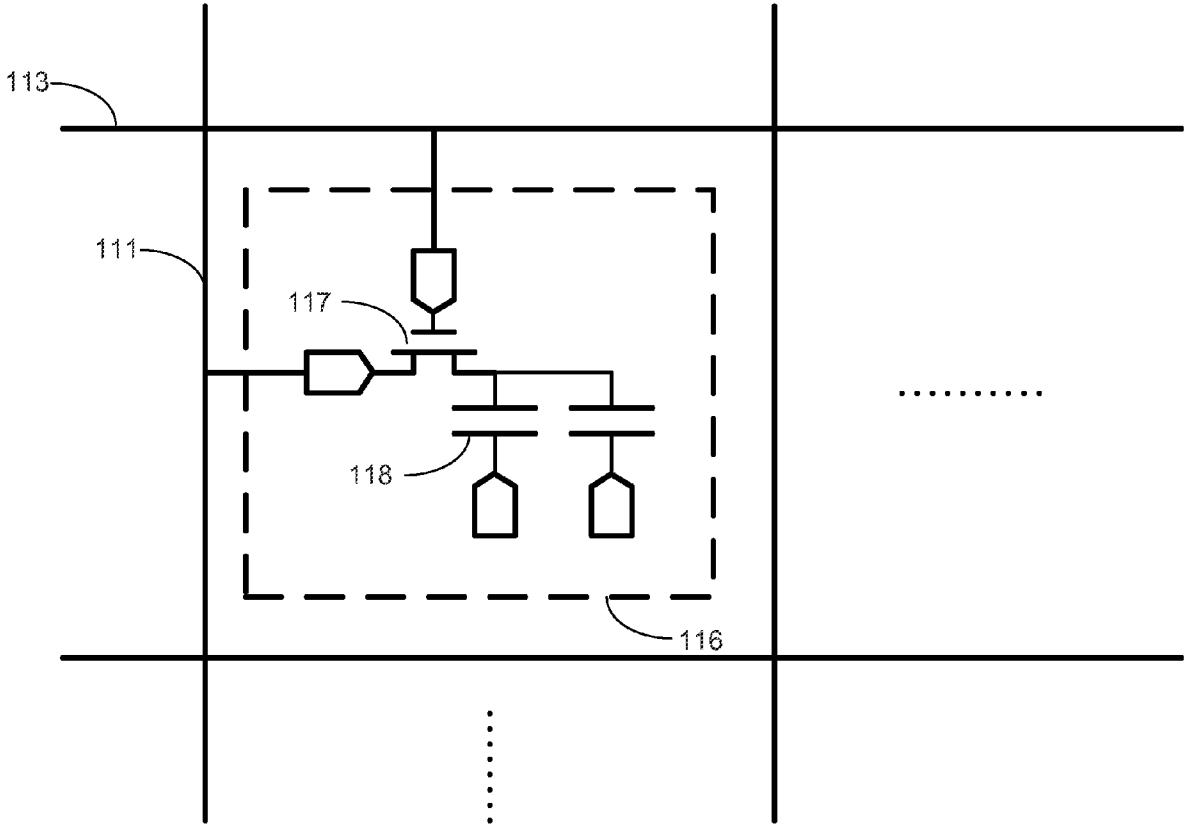
FIG. 2B schematically depicts a pixel according to one embodiment of the present disclosure.

FIG. 2B schematically depicts a pixel according to one embodiment of the present disclosure. As shown in FIG. 2B, a pixel 116 includes a pixel circuit, which is formed by a plurality of electronic elements, such as one or more thin-film transistors (TFTs) 117 and one or more capacitors 118. Interconnection of the electronic elements may vary according to different requirement of the pixel circuit. In certain embodiments, the TFT 117 serves as a switch. The source of the TFT 117 is connected to the data line 111 to receive the data signal, which controls the display of the pixel 116. The gate of the TFT 117 is connected to the scan line 113 to receive the scan signal, which controls the switch of the TFT 117. In certain embodiments, when the scan signal is at a high voltage level, the scan signal turns on the switch of the TFT 117 such that the data signal is transmittable from the source of the TFT 117 to the drain of the TFT 117. On the other hand, when the scan signal is at a low voltage level, the scan signal turns off the switch of the TFT 117, and the data signal is not transmittable to the drain of the TFT 117. Thus, by modulating the scan signals and the data signals, each pixel 116 may receive the corresponding data signal for displaying.

The controller 130 controls the display panel 110 for displaying the images. Specifically, the controller 130 is configured to generate signals for controlling the pixels 116 of the display panel 110, and control the inspection of the pixels 116.

Figure 3A:
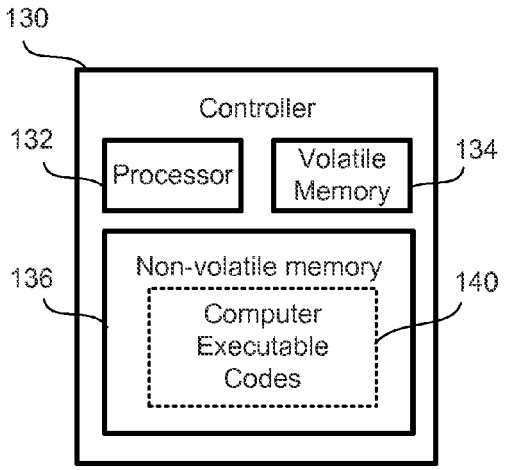
FIG. 3A schematically depicts a controller of the display device according to one embodiment of the present disclosure.

FIG. 3A schematically depicts a controller of the display device according to one embodiment of the present disclosure. As shown in FIG. 3A, the controller 130 includes a processor 132 for executing instructions, a volatile memory 134, and a non-volatile memory 136. The controller 130 may be a regular computer, a special purpose computer, or a specialized microcontroller capable of being installed in a computer, such as a microcontroller unit (MCU), a service processor (SP) or a baseboard management controller (BMC). In certain embodiments, the controller 130 may be integrated with the display panel 110, or may be separated from the display panel 110. In certain embodiments, the controller 130 may include other storage devices in addition to the volatile memory 134 and the non-volatile memory 136. For example, the storage devices may include a hard disk, a CD-ROM, a static random-access memory, a flash memory, or any types of storage unit as long as it may store data.

The processor 132 is a host processor of the controller 130, controlling operation and executing instructions of the controller 130. The volatile memory 134 is a temporary memory storing information in operation, such as the instructions executed by the processor 132. For example, the volatile memory 134 may store the threshold matrix and the measurement matrix generated by the matrix generating module 148. In certain embodiments, the volatile memory 134 may be a random-access memory (RAM). In certain embodiments, the volatile memory 134 is in communication to the processor 132 through appropriate buses or interfaces. In certain embodiments, the controller 130 may include more than one processor 132 or more than one volatile memory 134.

The non-volatile memory 136 is a persistent memory for storing data and instructions even when not powered. For example, the non-volatile memory 136 can be a flash memory. In certain embodiments, the non-volatile memory 136 is in communication to the processor 132 through appropriate buses or interfaces. In certain embodiments, the controller 130 may include more than one non-volatile memory 136.

As shown in FIG. 3A, the non-volatile memory 136 stores computer executable codes 140. The codes 140 are configured, when executed at the processor 132, to generate signals for controlling the pixels 116 of the display panel 110, and control the inspection of the pixels 116.

Figure 3B:
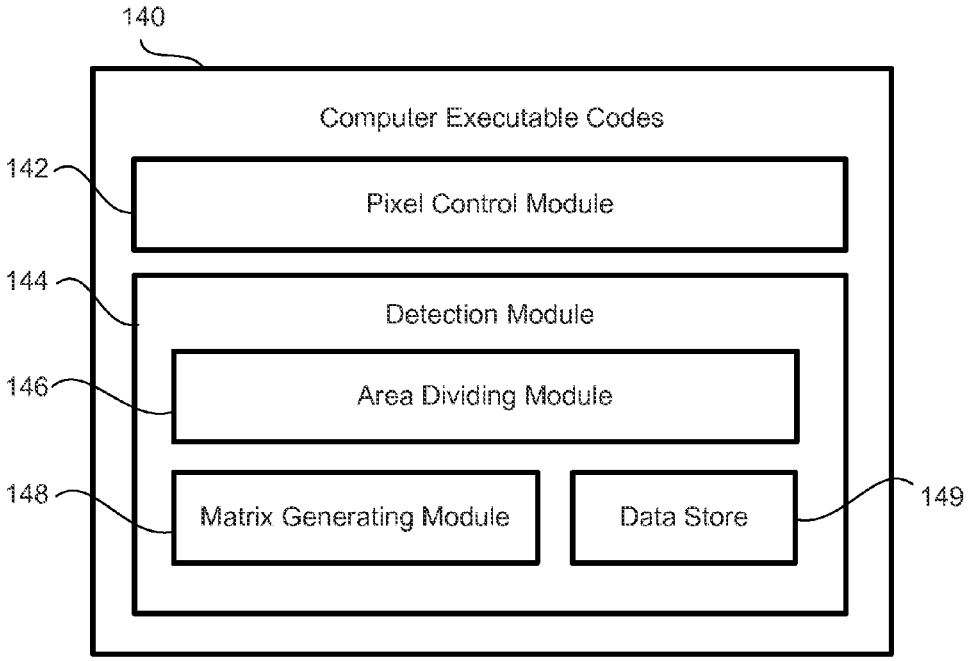
FIG. 3B schematically depicts computer executable codes of the controller according to one embodiment of the present disclosure.

FIG. 3B schematically depicts computer executable codes of the controller according to one embodiment of the present disclosure. As shown in FIG. 3B, the codes 140 include a pixel control module 142 and a detection module 144. The detection module 144 includes an area dividing module 146, a matrix generating module 148 and a data store 149.

The pixel control module 142 generates the scan signals and data signals for controlling the pixels 116. When the pixel control module 142 receives an instruction to display an image on the display panel 110, the pixel control module 142 generates the corresponding scan signals and data signals to the image, and sends the scan signals and data signals to the scan driver 114 and data driver 112 of the display panel 110. The image can be an all-white screen, an all-black screen, or other color images.

The detection module 144 controls the inspection of the pixels 116. Specifically, for dead pixel inspection, the detection module 144 are configured to divide the pixel matrix into a plurality of areas, to assign a threshold value for each of the areas, to issue instructions to the pixel control module 142 to sequentially control the pixels 116 in one area to display a single color and, in response, receive a photon current value corresponding to the area, and to compare the photon current value for each area with the threshold value to determine a flag value for the area.

The area dividing module 146 are configured to divide the pixel matrix into a plurality of areas. The area is a unit for inspection of the dead pixels. In certain embodiments, each area includes at least one pixel 116. In certain embodiments, each area includes a group of pixels 116.

In certain embodiments, to divide the pixel matrix into the areas, the area dividing module 146 determines the size of an area, and divides the whole pixel matrix into areas with the same size. For example, for a 1024*768 pixel matrix, the area dividing module 146 may determine the size of an area to include 8*8 pixels. Thus, the area dividing module 146 may divide the pixel matrix into 128*96 areas, with each area including 8*8 pixels. In certain embodiments, the size of the area may be a predetermined fixed size. In certain embodiments, the size of the area may be adjustable according to the feedback from the transparent photon collection module 150.

The matrix generating module 148 generates a plurality of matrices corresponding to the areas, and stores the matrices in the volatile memory 134. Each matrix has the same size to the number of the areas. For example, when the area dividing module 146 divides the pixel matrix into 128*96 areas, the size of each matrix generated by the matrix generating module 148 is also 128*96. Specifically, the matrix generating module 148 generates at least one threshold matrix and at least one measurement matrix to correspond to the areas. The threshold matrix stores the threshold value for each area, and the measurement matrix stores the measured photon current value for each area.

In certain embodiments, when the display panel 110 is a RGB color display panel, the matrix generating module 148 may generate three threshold matrices, three measurement matrices, and a result matrix corresponding to the final inspection result of the areas. Each threshold matrix and each measurement matrix correspond to one color. For example, the threshold matrix for the red color stores the threshold values for each area corresponding to the red color only, and the measurement matrix for the red color is configured to store the photon current values for each area when all pixels in the area display the red color. The result matrix is a collective status matrix showing the pixel status for all three colors. Since the white light is the combination of the RGB colors, the result matrix is a white color status matrix.

It should be appreciated that, as described above, the data such as the photon current values and the threshold values are stored in a plurality of matrices. However, when the data of the photon current values and the threshold values are stored in the volatile memory 134, the data structure of the photon current values and the threshold values may not necessarily be in the form of a matrix. In other words, any data structure can be used for the storage of the photon current values and the threshold values.

The data store 149 stores predetermined parameters and data for the detection module 144. For example, when the size of the area is a predetermined fixed size, the data store 149 stores the predetermined fixed size of the area. In certain embodiments, the data store 149 stores predetermined threshold values for each area.

In certain embodiments, when the display device 100 is up to inspection for dead pixels, the detection module 144 controls the area dividing module 146 to determine the size of one area, and to divide the pixel matrix into a plurality of areas. Then, the detection module 144 controls the matrix generating module 148 to generate at least one threshold matrix and at least one measurement matrix corresponding to the areas, and to assign a threshold value for each of the areas. Once each area has a threshold value, the detection module 144 issues an instruction to the pixel control module 142 to control the pixels 116 in one area to display a single color. For example, when the display panel 110 is a RGB color display panel, the detection module 144 may issue an instruction to the pixel control module 142 to control the pixels 116 in one area to display the red color, the green color, and the blue color respectively.

After measuring all areas for all colors, the detection module 144 may compare the photon current value for each area with the threshold value to determine a flag value for the area. In certain embodiments, for each area, when the measured photon current value is greater than or equal to the threshold value, the area presumably has no dead pixels. When the measured photon current value is smaller than the threshold value, dead pixels may exist in the area. To indicate the comparison result, the detection module 144 may record a flag value for each area in the measurement matrix. For example, a flag value of 0 indicates that the measured photon current value is greater than or equal to the threshold value (no dead pixels), and a flag value of 1 indicates that the measured photon current value is smaller than the threshold value (dead pixels exist).

After generating the flag values of all areas for each color, the detection module 144 may record a status flag for each area in the result matrix according to the flag values corresponding to the three colors. In certain embodiments, the status flag may be an integer between 0 and 7, corresponding to the eight type of (R, G, B) status for each area. For example, a status flag of 0 refers to (0, 0, 0), indicating that all pixels of the RGB colors are operable in the area. A status flag of 1 may refer to (1, 0, 0), indicating that the pixels in red color may have dead pixels, and the pixels in green and blue colors are operable. A status flag of 2 may refer to (0, 1, 0), indicating that the pixels in green color may have dead pixels, and the pixels in red and blue colors are operable. A status flag of 3 may refer to (0, 0, 1), indicating that the pixels in blue color may have dead pixels, and the pixels in green and red colors are operable. A status flag of 4 may refer to (1, 1, 0), indicating that the pixels in red and green colors may have dead pixels, and the pixels in blue color are operable. A status flag of 5 may refer to (1, 0, 1), indicating that the pixels in red and blue colors may have dead pixels, and the pixels in green color are operable. A status flag of 6 may refer to (0, 1, 1), indicating that the pixels in blue and green colors may have dead pixels, and the pixels in red color are operable. A status flag of 7 refers to (1, 1, 1), indicating that all pixels of the RGB colors may include dead pixels.

The transparent photon collection panel 150 is a light sensitive panel. When the transparent photon collection panel 150 receives enough photon, the transparent photon collection panel 150 generates electrical photon current. The electrical current may be provided to the display module 102 or other electric device as power. In certain embodiments, the transparent photon collection module 150 can be a transparent solar panel.

In certain embodiments, when the display panel 110 emits light, the transparent photon collection panel 150 collects photons emitted by the display panel 110. In response to the photons collected, the transparent photon collection panel 150 generates a photon current, and sends the photon current to the A/D converter 170. The photon current is in proportion to the light emitted by the display panel 110. For example, when the display panel 110 shows an all-black screen, the photon current generated by the transparent photon collection panel 150 is a minimum current because there is no light emitted by the display panel 110. When the display panel 110 shows an all-white screen, the photon current generated by the transparent photon collection panel 150 is a maximum current because there is maximum amount of light emitted by the display panel 110. The sensitivity of the transparent photon collection panel 150 relates to the size of the areas. In certain embodiments, when the transparent photon collection panel 150 is sensitive enough, the size of the areas may be down to one pixel size.

It should be appreciated that the transparent photon collection panel 150 may receive environmental photons not emitted by the display panel 110. Thus, when the display panel 110 shows an all-black screen, the minimum current generated by the transparent photon collection panel 150 is not necessarily zero.

This is because there is no light emitted by the display panel 110, but the environmental photons have been received by the transparent photon collection panel 150.

The A/D converter 170 is a converter to convert analog signals to digital signals. When the A/D converter 170 receives the photon current (which is an analog signal) from the transparent photon collection panel 150, the A/D converter 170 converts the analog photon current signal to digital photon current value, and sends the photon current value to the controller 130 through the input port 190.

Figure 4:
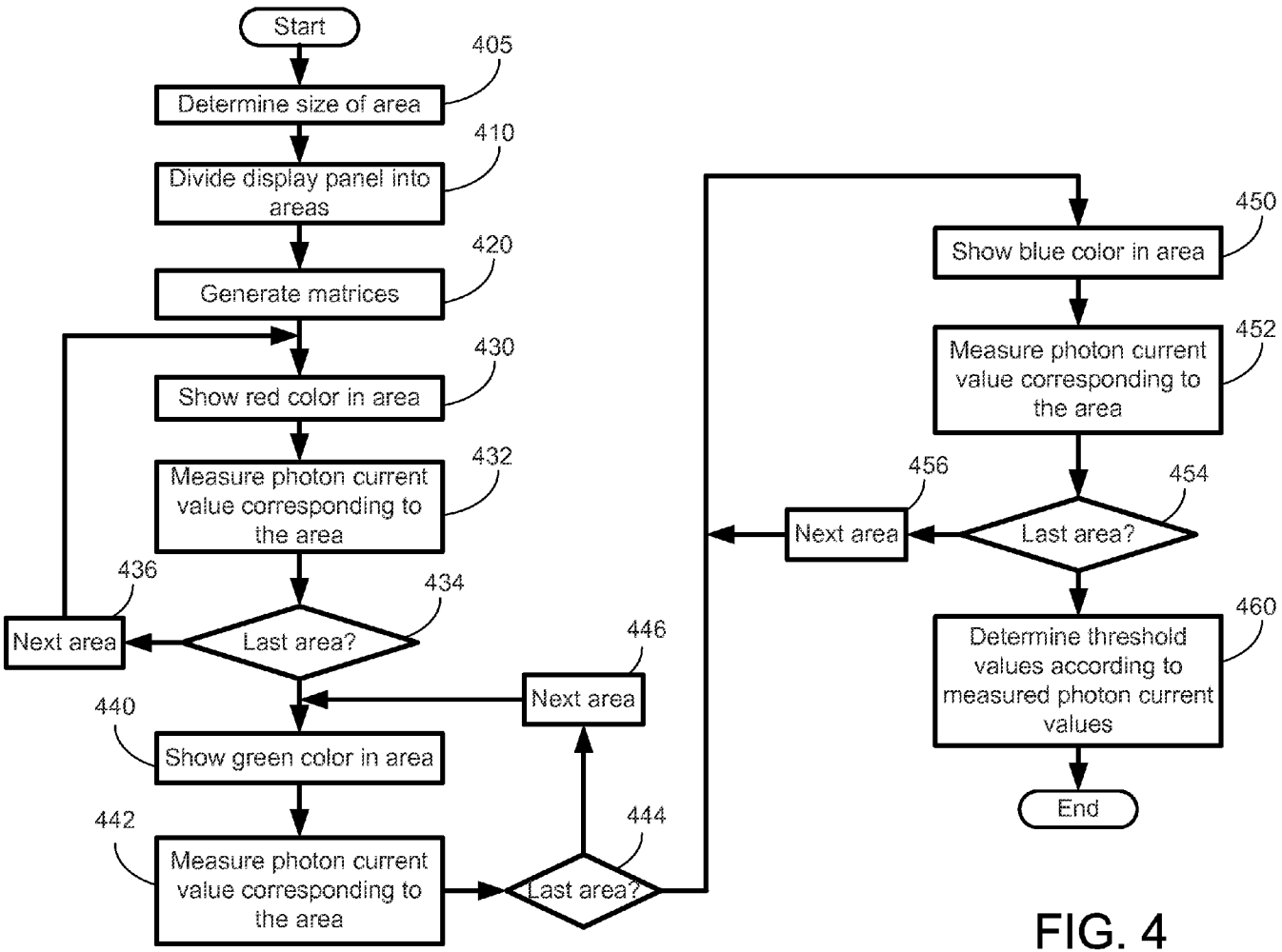
FIG. 4 shows an exemplary flow chart of generating threshold values with a new display device according to one embodiment of the present disclosure.

FIG. 4 shows an exemplary flow chart of generating threshold values with a new display device according to one embodiment of the present disclosure. In this embodiment, the display device 100 includes a RGB color display panel.

Generally, for a brand new display device 100, all pixels 116 of the display panel 110 are presumably operable. In other words, the new display panel 110 has no dead pixels. Thus, the new display device 100 may be used to perform the inspection process to determine the threshold value for each area. By controlling the pixels 116 in one area to display a single color and all other areas in black, the photon current generated by the transparent photon collection panel 150 is a threshold current of the area.

At operation 405, the area dividing module 146 determines the size of an area. For example, the area dividing module 146 may determine the area to include 8*8 pixels. Then, at operation 410, the area dividing module 146 divides the pixel matrix of the display panel 110 into areas, with each area having the same size.

At operation 420, the matrix generating module 148 generates the threshold matrices and the measurement matrices. The size of each matrix corresponds to the number of the areas. In certain embodiments, for the RGB color display panel, the matrix generating module 148 generates three threshold matrices and three measurement matrices in response to the three colors of RGB, and one result matrix for the final result of inspection.

At operation 430, the detection module 144 may issue an instruction to the pixel control module 142 to control the pixels 116 in one area to display the red color. At this time, the area is the only area to display the red color, and all other areas display the black color.

At operation 432, the photon collection module 104 measures the photon current value corresponding to the area emitting the red color. Specifically, the transparent photon collection panel 150 receives the photons emitted from the area, and generates a corresponding photon current. The A/D converter 170 converts the photon current generated by the transparent photon collection panel 150 to the digital photon current value, and sends the photon current value to the controller 130. The detection module 144 receives the photon current value, and stores the photon current value in the measurement matrix for the red color.

At operation 434, the detection module 144 checks if the measured area is the last area of the display panel 110 for the red color. When the area is the last area, the detection module 144 enters operation 440 for the next color. When there are other areas to be measured, the detection module 144 enters operation 436. At operation 436, the detection module 144 selects the next area to be measured, and goes back to operation 430.

At operation 440, the detection module 144 may issue an instruction to the pixel control module 142 to control the pixels 116 in one area to display the green color. At this time, the area is the only area to display the green color, and all other areas display the black color.

At operation 442, the photon collection module 104 measures the photon current value corresponding to the area emitting the green color. Specifically, the transparent photon collection panel 150 receives the photons emitted from the area, and generates a corresponding photon current. The A/D converter 170 converts the photon current generated by the transparent photon collection panel 150 to the digital photon current value, and sends the photon current value to the controller 130. The detection module 144 receives the photon current value, and stores the photon current value in the measurement matrix for the green color.

At operation 444, the detection module 144 checks if the measured area is the last area of the display panel 110 for the green color. When the area is the last area, the detection module 144 enters operation 450 for the next color. When there are other areas to be measured, the detection module 144 enters operation 446. At operation 446, the detection module 144 selects the next area to be measured, and goes back to operation 440.

At operation 450, the detection module 144 may issue an instruction to the pixel control module 142 to control the pixels 116 in one area to display the blue color. At this time, the area is the only area to display the blue color, and all other areas display the black color.

At operation 452, the photon collection module 104 measures the photon current value corresponding to the area emitting the blue color. Specifically, the transparent photon collection panel 150 receives the photons emitted from the area, and generates a corresponding photon current. The A/D converter 170 converts the photon current generated by the transparent photon collection panel 150 to the digital photon current value, and sends the photon current value to the controller 130. The detection module 144 receives the photon current value, and stores the photon current value in the measurement matrix for the blue color.

At operation 454, the detection module 144 checks if the measured area is the last area of the display panel 110 for the blue color. When the area is the last area, the detection module 144 enters operation 460. When there are other areas to be measured, the detection module 144 enters operation 456. At operation 456, the detection module 144 selects the next area to be measured, and goes back to operation 450.

At operation 460, when all measurements are finished, the detection module 144 determines the threshold values for each color according to the measured photon current values. In certain embodiments, the measured photon current values for each color become the threshold values for each color. In certain embodiments, the detection module 144 may use other algorithms to determine the threshold values for each color according to the measured photon current values. The determined threshold values for each color may be stored in the data store 149 for later inspection use.

FIG. 4 shows operations 430 to 456 in the R-G-B color sequence. However, the R-G-B color sequence is provided only as one embodiment. It should be appreciated that there is no particular color sequence or area sequence for the inspection of the pixels. In certain embodiments, the detection module 144 may issue instructions to the pixel control module 142 to control the pixels 116 in one area to sequentially display all three colors, and measure the photon current values for all three colors, before moving to the next area.

Figure 5:
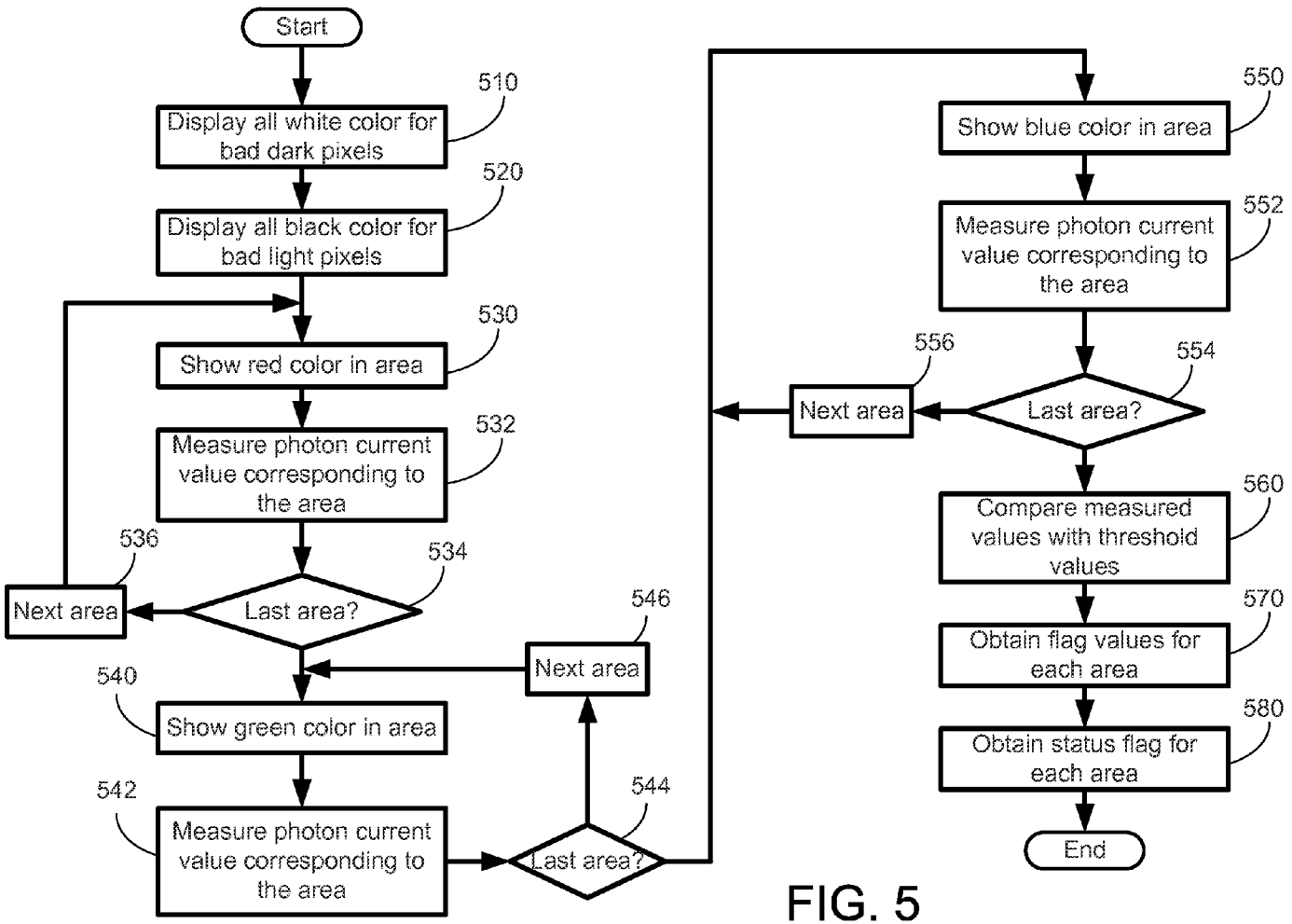
FIG. 5 shows an exemplary flow chart of inspecting the pixels of the display device according to one embodiment of the present disclosure.

FIG. 5 shows an exemplary flow chart of inspecting the pixels of the display device according to one embodiment of the present disclosure. In this embodiment, the display device 100 includes a RGB color display panel, and the matrix generating module 148 has generated the threshold matrices, the measurement matrices and the result matrix. The threshold values for the RGB colors have been stored in the threshold matrices. In certain embodiments, the threshold values for each color may be predetermined values, or may be determined by the process as shown in FIG. 4.

At operation 510, the detection module 144 may issue an instruction to the pixel control module 142 to control all pixels 116 of the display panel 110 to display all white color for checking bad dark pixels. If any of the pixels 116 is dark, the pixel 116 is a dead pixel.

At operation 520, the detection module 144 may issue an instruction to the pixel control module 142 to control all pixels 116 of the display panel 110 to display all black color for checking bad light pixels. If any of the pixels 116 is light (or not dark), the pixel 116 is a dead pixel.

At operation 530, the detection module 144 may issue an instruction to the pixel control module 142 to control the pixels 116 in one area to display the red color. At this time, the area is the only area to display the red color, and all other areas display the black color.

At operation 532, the photon collection module 104 measures the photon current value corresponding to the area emitting the red color. Specifically, the transparent photon collection panel 150 receives the photons emitted from the area, and generates a corresponding photon current. The A/D converter 170 converts the photon current generated by the transparent photon collection panel 150 to the digital photon current value, and sends the photon current value to the controller 130. The detection module 144 receives the photon current value, and stores the photon current value in the measurement matrix for the red color.

At operation 534, the detection module 144 checks if the measured area is the last area of the display panel 110 for the red color. When the area is the last area, the detection module 144 enters operation 540 for the next color. When there are other areas to be measured, the detection module 144 enters operation 536. At operation 536, the detection module 144 selects the next area to be measured, and goes back to operation 530.

At operation 540, the detection module 144 may issue an instruction to the pixel control module 142 to control the pixels 116 in one area to display the green color. At this time, the area is the only area to display the green color, and all other areas display the black color.

At operation 542, the photon collection module 104 measures the photon current value corresponding to the area emitting the green color. Specifically, the transparent photon collection panel 150 receives the photons emitted from the area, and generates a corresponding photon current. The A/D converter 170 converts the photon current generated by the transparent photon collection panel 150 to the digital photon current value, and sends the photon current value to the controller 130. The detection module 144 receives the photon current value, and stores the photon current value in the measurement matrix for the green color.

At operation 544, the detection module 144 checks if the measured area is the last area of the display panel 110 for the green color. When the area is the last area, the detection module 144 enters operation 550 for the next color. When there are other areas to be measured, the detection module 144 enters operation 546. At operation 546, the detection module 144 selects the next area to be measured, and goes back to operation 540.

At operation 550, the detection module 144 may issue an instruction to the pixel control module 142 to control the pixels 116 in one area to display the blue color. At this time, the area is the only area to display the blue color, and all other areas display the black color.

At operation 552, the photon collection module 104 measures the photon current value corresponding to the area emitting the blue color. Specifically, the transparent photon collection panel 150 receives the photons emitted from the area, and generates a corresponding photon current. The A/D converter 170 converts the photon current generated by the transparent photon collection panel 150 to the digital photon current value, and sends the photon current value to the controller 130. The detection module 144 receives the photon current value, and stores the photon current value in the measurement matrix for the blue color.

At operation 554, the detection module 144 checks if the measured area is the last area of the display panel 110 for the blue color. When the area is the last area, the detection module 144 enters operation 560. When there are other areas to be measured, the detection module 144 enters operation 556. At operation 556, the detection module 144 selects the next area to be measured, and goes back to operation 550.

At operation 560, the detection module 144 compares the measured photon current value in the measurement matrices for each color with the threshold values in the threshold matrices for each color. For each area, when the measured photon current value is greater than or equal to the threshold value, the area presumably has no dead pixels. When the measured photon current value is smaller than the threshold value, dead pixels may exist in the area.

At operation 570, the detection module 144 obtains the flag values for each area according to the comparison result. As described above, a flag value of 0 may indicate that the measured photon current value is greater than or equal to the threshold value (no dead pixels), and a flag value of 1 may indicate that the measured photon current value is smaller than the threshold value (dead pixels exist). In certain embodiments, the flag values for each area are stored in the measurement matrices.

At operation 580, the detection module 144 obtains a status flag for each area. The detection module 144 may store the status flags in the result matrix. The status flag for each area indicates the pixel status of each area. As described above, the status flag may be an integer between 0 and 7, corresponding to the eight type of (R, G, B) status for each area. For example, a status flag of 0 refers to (0, 0, 0), indicating that all pixels of the RGB colors are operable in the area. A status flag of 1 may refer to (1, 0, 0), indicating that the pixels in red color may have dead pixels, and the pixels in green and blue colors are operable. A status flag of 2 may refer to (0, 1, 0), indicating that the pixels in green color may have dead pixels, and the pixels in red and blue colors are operable. A status flag of 3 may refer to (0, 0, 1), indicating that the pixels in blue color may have dead pixels, and the pixels in green and red colors are operable. A status flag of 4 may refer to (1, 1, 0), indicating that the pixels in red and green colors may have dead pixels, and the pixels in blue color are operable. A status flag of 5 may refer to (1, 0, 1), indicating that the pixels in red and blue colors may have dead pixels, and the pixels in green color are operable. A status flag of 6 may refer to (0, 1, 1), indicating that the pixels in blue and green colors may have dead pixels, and the pixels in red color are operable. A status flag of 7 refers to (1, 1, 1), indicating that all pixels of the RGB colors may include dead pixels.

FIG. 5 shows operations 530 to 556 in the R-G-B color sequence. However, the R-G-B color sequence is provided only as one embodiment. It should be appreciated that there is no particular color sequence or area sequence for the inspection of the pixels. In certain embodiments, the detection module 144 may issue instructions to the pixel control module 142 to control the pixels 116 in one area to sequentially display all three colors, and measure the photon current values for all three colors, before moving to the next area.

FIGS. 4 and 5 describe a RGB color display device for the inspection of RGB color pixels. However, the inspection method may be utilized for inspection of pixels in any types of black-and-white or color display devices.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A display device, comprising:

a display panel, defining a plurality of pixels in a pixel matrix;

a controller configured to control the pixels of the display panel, the controller comprising a processor and a non-volatile memory storing computer executable codes, wherein the codes, when executed at the processor, is configured to divide the pixel matrix into a plurality of areas, wherein each area comprises at least one pixel, assign a threshold value for each of the areas, control the pixels in one area to emit light displaying a color, and in response, receive a photon current value corresponding to the area, and compare, for each of the areas, the photon current value with the threshold value to determine a flag value for the area;

a transparent photon collection panel attached to the display panel, wherein the transparent photon collection panel is configured to receive the light displayed by the area and to generate an analog signal in response to the light; and an analog to digital (A/D) converter electrically connected to the transparent photon collection panel and the controller, wherein the A/D converter is configured to receive the analog signal from the transparent photon collection panel, to convert the analog signal to the photon current value, and to send the photon current value to the controller.

2. The display device as claimed in claim 1, wherein the codes comprise:

a pixel control module configured to generate display signals to control the pixels of the display panel; and a detection module configured to divide the pixel matrix into the areas, to assign the threshold value for each of the areas, to sequentially control the pixels in the areas to emit light displaying a color, to receive the photon current value corresponding to the area, and to compare, for each of the areas, the photon current value with the threshold value to determine the flag value for the area.

3. The display device as claimed in claim 2, wherein the display signals comprise a plurality of scan signals and a plurality of data signals.

4. The display device as claimed in claim 3, wherein the display panel comprises:

a scan driver electrically connected to the controller, configured to receive the scan signals from the controller;

a data driver electrically connected to the controller, configured to receive the data signals from the controller;

a plurality of scan lines electrically connected to the scan driver, each scan line configured to receive one of the scan signals from the scan driver; and a plurality of data lines electrically connected to the data driver, each data line configured to receive one of the data signals from the data driver;

wherein the scan lines and data lines cross over to define the plurality of pixels.

5. The display device as claimed in claim 2, wherein the detection module comprises:

an area dividing module configured to determine a size of each area, and to divide the pixel matrix into the areas according to the size of each area; and a matrix generating module configured to generate at least one threshold matrix storing the threshold values and at least one measurement matrix storing the photon current values for the areas, wherein each of the at least one threshold matrix and the at least one measurement matrix corresponding to a number of the areas.

6. The display device as claimed in claim 5, wherein the display panel is a color display panel configured to display in red/green/blue (RGB) colors.

7. The display device as claimed in claim 6, wherein the matrix generating module is configured to generate:

three threshold matrices storing the threshold values for the areas in the RGB colors, respectively; and three measurement matrices storing the photon current values for the areas in the RGB colors, respectively.

8. The display device as claimed in claim 7, wherein for each of the areas in each of the RGB colors, the detection module is configured to compare the photon current value stored in the measurement matrix with the threshold value stored in the threshold matrix, and to store the flag value in the measurement matrix.

9. The display device as claimed in claim 8, wherein the matrix generating module is configured to generate a result matrix storing a status flag for each area, wherein for each area, the status flag is determined according to the flag values of the RGB colors.

10. The display device as claimed in claim 1, wherein the transparent photon collection panel is a transparent solar panel.

11. A method of inspecting a display device, comprising:

dividing a display panel of the display device into a plurality of areas, wherein the display panel defines a plurality of pixels in a pixel matrix, and each area comprises at least one pixel;

assigning a threshold value for each of the areas;

controlling the pixels in one area to emit light displaying a color, wherein a transparent photon collection panel of the display device is configured to receive the light displayed by the area and to generate an analog signal in response to the light, and an analog to digital (A/D) converter of the display device is configured to receive the analog signal from the transparent photon collection panel and to convert the analog signal to a photon current value corresponding to the area;

receiving the photon current value corresponding to the area; and comparing, for each of the areas, the photon current value with the threshold value to determine a flag value for the area.

12. The method as claimed in claim 11, further comprising:

generating display signals to control the pixels of the display panel, wherein the display signals comprise a plurality of scan signals and a plurality of data signals.

13. The method as claimed in claim 12, wherein the display panel comprises:

a scan driver electrically connected to the controller, configured to receive the scan signals from the controller;

a data driver electrically connected to the controller, configured to receive the data signals from the controller;

a plurality of scan lines electrically connected to the scan driver, each scan line configured to receive one of the scan signals from the scan driver; and a plurality of data lines electrically connected to the data driver, each data line configured to receive one of the data signals from the data driver;

wherein the scan lines and data lines cross over to define the plurality of pixels.

14. The method as claimed in claim 11, wherein the display panel is divided into a plurality of areas by:

determining a size of each area; and dividing the pixel matrix into the areas according to the size of each area.

15. The method as claimed in claim 11, further comprising:

generating at least one threshold matrix storing the threshold values and at least one measurement matrix storing the photon current values for the areas, wherein each of the at least one threshold matrix and the at least one measurement matrix corresponding to a number of the areas.

16. The method as claimed in claim 15, wherein the display panel is a color display panel configured to display in red/green/blue (RGB) colors;

the at least one threshold matrix comprises three threshold matrices storing the threshold values for the areas in the RGB colors, respectively; and the at least one measurement matrix comprises three measurement matrices storing the photon current values for the areas in the RGB colors, respectively.

17. The method as claimed in claim 16, further comprising:

generating a result matrix storing a status flag for each area;

storing, for each of the areas in each of the RGB colors, the flag value in the measurement matrix; and determining, for each of the areas, the status flag according to the flag values of the RGB colors.

18. The method as claimed in claim 11, wherein the transparent photon collection panel is a transparent solar panel.

19. A non-transitory computer readable medium storing computer executable codes, wherein the codes, when executed at a processor, are configured to divide a display panel into a plurality of areas, wherein the display panel defines a plurality of pixels in a pixel matrix, and each area comprises at least one pixel;

assign a threshold value for each of the areas;

control the pixels in one area to emit light displaying a color, wherein a transparent photon collection panel of the display device is configured to receive the light displayed by the area and to generate an analog signal in response to the light, and an analog to digital (A/D) converter of the display device is configured to receive the analog signal from the transparent photon collection panel and to convert the analog signal to a photon current value corresponding to the area;

receive the photon current value corresponding to the area, and compare, for each of the areas, the photon current value with the threshold value to determine a flag value for the area.

20. The non-transitory computer readable medium as claimed in claim 19 wherein the codes comprise:

a pixel control module configured to generate display signals to control the pixels of the display panel, wherein the display signals comprise a plurality of scan signals and a plurality of data signals; and a detection module configured to divide the pixel matrix into the areas, to assign the threshold value for each of the areas, to sequentially control the pixels in the areas to emit light displaying a color, to receive the photon current value corresponding to the area, and to compare, for each of the areas, the photon current value with the threshold value to determine the flag value for the area.

21. The non-transitory computer readable medium as claimed in claim 20, wherein the display panel comprises:

a scan driver electrically connected to the controller, configured to receive the scan signals from the controller;

a data driver electrically connected to the controller, configured to receive the data signals from the controller;

a plurality of scan lines electrically connected to the scan driver, each scan line configured to receive one of the scan signals from the scan driver; and a plurality of data lines electrically connected to the data driver, each data line configured to receive one of the data signals from the data driver;

wherein the scan lines and data lines cross over to define the plurality of pixels.

22. The non-transitory computer readable medium as claimed in claim 20, wherein the detection module comprises:

an area dividing module configured to determine a size of each area, and to divide the pixel matrix into the areas according to the size of each area; and a matrix generating module configured to generate at least one threshold matrix storing the threshold values and at least one measurement matrix storing the photon current values for the areas, wherein each of the at least one threshold matrix and the at least one measurement matrix corresponding to a number of the areas.

23. The non-transitory computer readable medium as claimed in claim 22, wherein the display panel is a color display panel configured to display in red/green/blue (RGB) colors;

the matrix generating module is configured to generate three threshold matrices storing the threshold values for the areas in the RGB colors, respectively, and three measurement matrices storing the photon current values for the areas in the RGB colors, respectively; and for each of the areas in each of the RGB colors, the detection module is configured to compare the photon current value stored in the measurement matrix with the threshold value stored in the threshold matrix, and to store the flag value in the measurement matrix.

24. The non-transitory computer readable medium as claimed in claim 23, wherein the matrix generating module is configured to generate a result matrix storing a status flag for each area, wherein for each area, the status flag is determined according to the flag values of the RGB colors.

25. The non-transitory computer readable medium as claimed in claim 19, wherein the transparent photon collection panel is a transparent solar panel.

* * * * *